US006167570B1

(12) United States Patent
Su

(10) Patent No.: US 6,167,570 B1
(45) Date of Patent: Jan. 2, 2001

(54) MULTIFUNCTION CAP STRUCTURE

(76) Inventor: Ming-Shu Su, 18F-2, No. 2, Lane 175, Sect. 3, Shiou-Lang Road, Chung-Ho City, Taipei Hsien 235 (TW)

( * ) Notice: Under 35 U.S.C. 154(b), the term of this patent shall be extended for 0 days.

(21) Appl. No.: 09/374,529

(22) Filed: Aug. 16, 1999

(51) Int. Cl.[7] ..... A42B 1/24
(52) U.S. Cl. ..... 2/209.13; 2/906; 40/329; 362/106
(58) Field of Search ..... 2/209.13, 195.1, 2/906; 40/542, 544, 586, 714, 716, 124.02, 329; 362/106, 107, 105, 806

(56) References Cited

U.S. PATENT DOCUMENTS 2,908,012 * 10/1959 Feldman ..... 2/209.13
4,665,568 * 5/1987 Stutes ..... 2/209.13
4,667,274 * 5/1987 Daniel ..... 2/209.13
5,111,366 * 5/1992 Rife et al. ..... 2/209.13
5,177,812 * 1/1993 DeMars ..... 2/209.13
5,680,718 * 10/1997 Ratcliffe et al. ..... 2/195.1
5,829,063 * 11/1998 Cheng ..... 2/209.13

* cited by examiner

*Primary Examiner*—Amy B. Vanatta
(74) *Attorney, Agent, or Firm*—Dougherty & Troxell

(57) ABSTRACT

An improved structure multifunction cap comprised of cap having a placement section on the front surface with incisions on two sides and capable of accommodating the insertion and mounting of a luminescent picture as well as isolating the forehead of the user from direct contact with the luminescent picture, thereby preventing electrocution. Furthermore, there is a containment section on the side that provides for the insertion of a controller circuit which switches the power source to the luminescent picture on and off. As such, the structure of the present invention allows the multifunction cap to be worn in the day for general use, but is capable of enhanced visual attractiveness when worn at night and, furthermore, prevents electrical shock to the user while the cap is worn to ensure physical safety.

5 Claims, 3 Drawing Sheets

MULTIFUNCTION CAP STRUCTURE

BACKGROUND OF THE INVENTION

1) Field of the Invention

The invention herein relates to an improved structure of a multifunction cap that can be utilized during the day or night because the cap is designed with a placement section and a containment section. The cap of the present invention may be worn in the day for general use, but is capable of enhanced visual attractiveness when worn at night and, furthermore, prevents electrical shock to the user while the cap is worn to ensure physical safety.

2) Description of the Prior Art

In an age of increasing technological development, people have become very particular about products required for daily life. Hats are among these products and includes sports and leisure caps. However, besides protection from the sun and rain, such headwear offers virtually no other utility. As a result, manufacturers have been researching and developing additional practical functions so users can wear them at night. Referring to FIG. 1, a luminescent picture and controller circuit are built into a conventional cap such that when the user participates in a nighttime activity such as a baseball game, basketball game, or just strolling on the road, the user is easily discerned by people and oncoming vehicles, which increases physical safety and, furthermore, enhances the visual attractiveness of the cap.

In a conventional multifunction cap design, as indicated in FIG. 2, an empty insert section 11 is formed on the front surface of the cap 1 and the luminescent picture 2 is slipped in through the side slot 111 of the empty insert section 11 and then the controller circuit 3 is attached onto the luminescent picture 2 at the upper extent of the cap 1 and is also connected to the luminescent picture 2 to enable the luminescent picture 2 to emit light. However, since the empty insert section 11 on the front surface of the cap 1 is a bare space, there is no medium of isolation when the luminescent picture 2 is slipped in, such that when the cap 1 is worn, the forehead of the user directly contacts the luminescent picture 2 and receives an electric shock which injures the user; furthermore, since the controller circuit 3 attached to the luminescent picture 2 at the upper extent of the cap 1 is not of a pocketed design, the user experiences head discomfort when the cap 1 is worn for an extended period and, furthermore, the controller circuit 3 is easily loosened and dislodged when the cap 1 is repeatedly worn and removed, resulting in poor illumination performance by the luminescent picture 2; additionally, since the empty insert section 11 on the front surface of the cap 1 is devoid of content, when the luminescent picture 2 is inoperative and not installed, the cap 1 cannot be worn in the daytime or nighttime because of its unbecoming appearance.

In view of the shortcomings of the conventional luminescent cap, the inventor of the invention herein, based on many years of experience in the related industry and with the specialized technology, completed the research and development of the improved structure multifunction cap of the invention herein.

SUMMARY OF THE INVENTION

The primary objective of the invention herein is to provide an improved structure of a multifunction cap having a placement section on the front surface with incisions on two sides and capable of accommodating the insertion of a luminescent picture as well as isolating the forehead of the user from direct contact with the luminescent picture, thereby precluding the hazard of electrocution and, furthermore, any pattern can be drawn or mounted on the said placement section. The multifunction cap of the present invention also has a containment section on the side that provides for the insertion of a controller circuit which switches the power source to the said luminescent picture on and off. As such, the structure of the present invention allows the multifunction cap to be worn in the day for general use, but is capable of enhanced visual attractiveness when worn at night and, furthermore, prevents electrical shock to the user while the cap is worn to ensure physical safety.

To enable the examination and promote further understand of the functions, structure, and other innovations of present invention, the brief description of the drawings below is followed by the detailed description of the preferred embodiments.

BRIEF DESCRIPTION OF THE DRAWINGS

FIG. 4A is a cross-sectional drawing of the placement section A of FIG. 4.

FIG. 5 is a perspective view of the present invention.

DETAILED DESCRIPTION OF THE PREFERRED EMBODIMENTS

Figure 1:
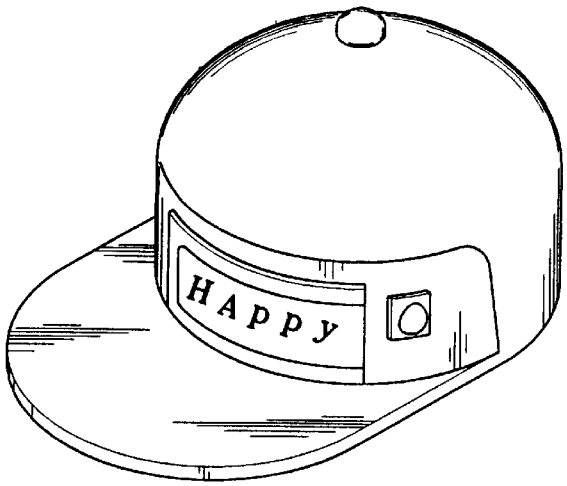
FIG.1 (Prior Art)
FIG. 1 is an isometric drawing of a conventional multifunction cap.
Figure 2:
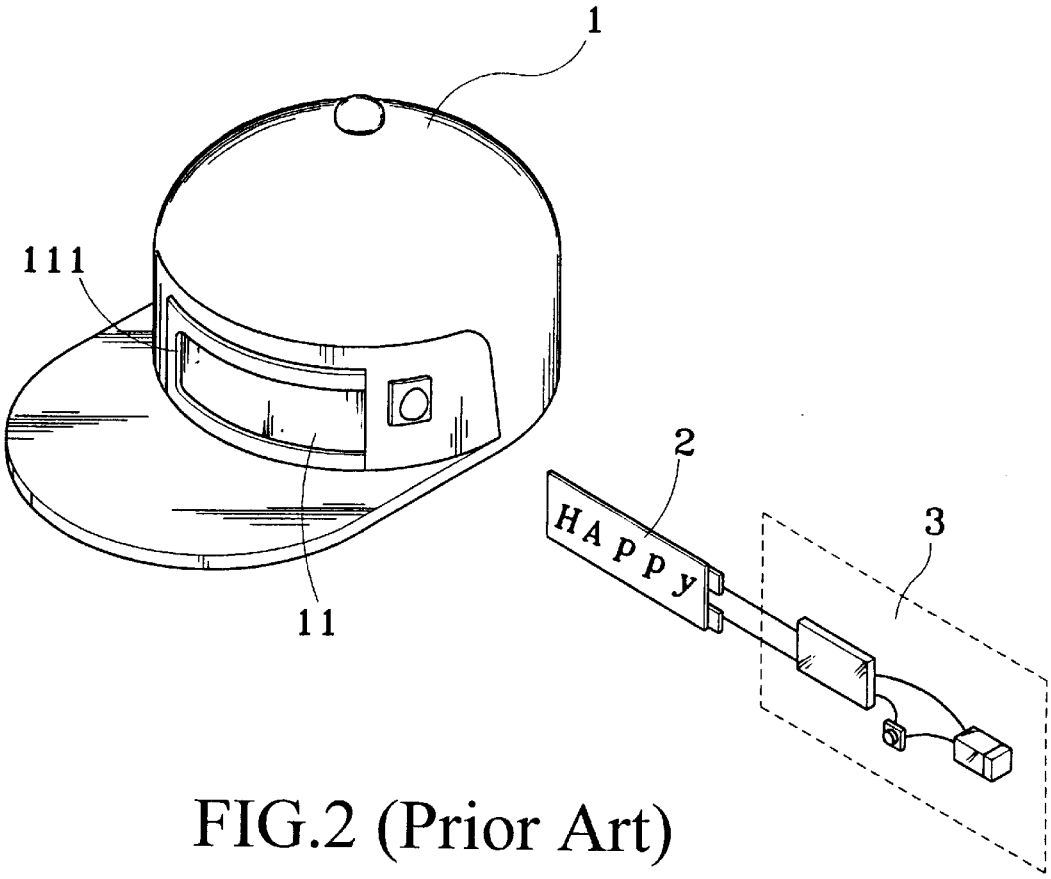
FIG.2 (Prior Art)
FIG. 2 is an exploded drawing of a conventional multifunction cap.
Figure 3:
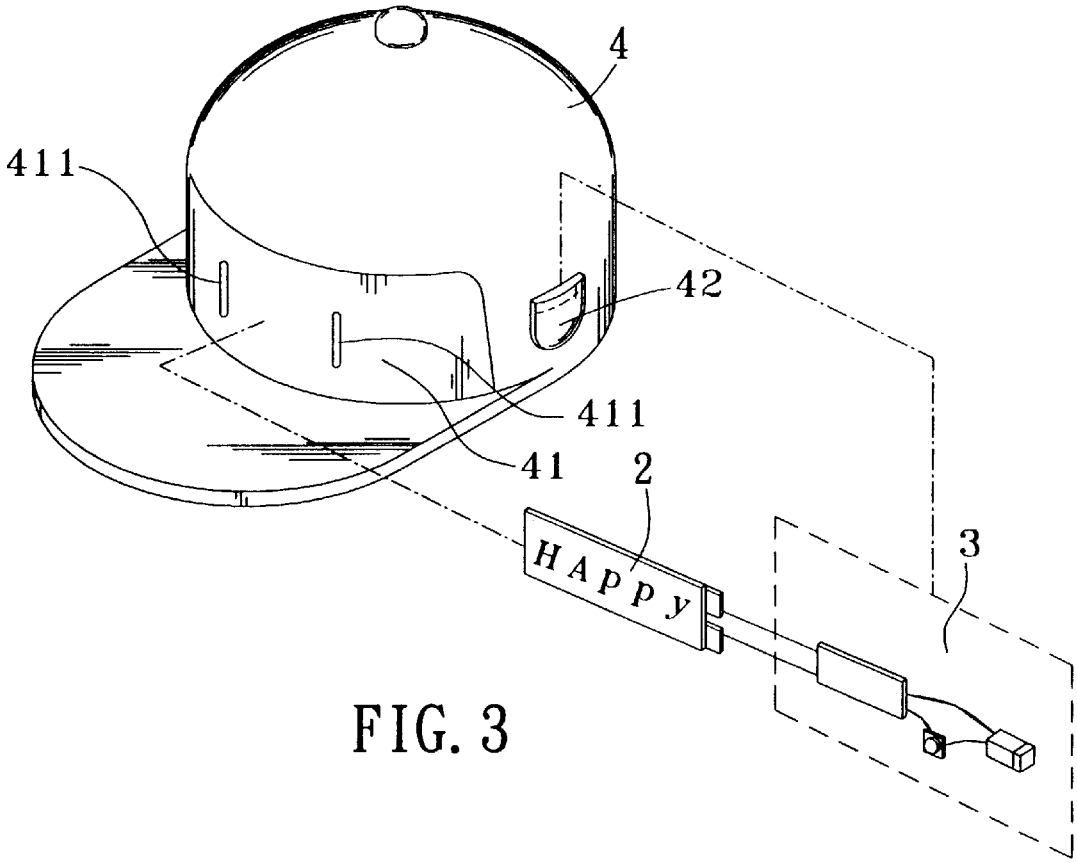
FIG. 3 is an exploded drawing of the invention herein.
Figure 4:
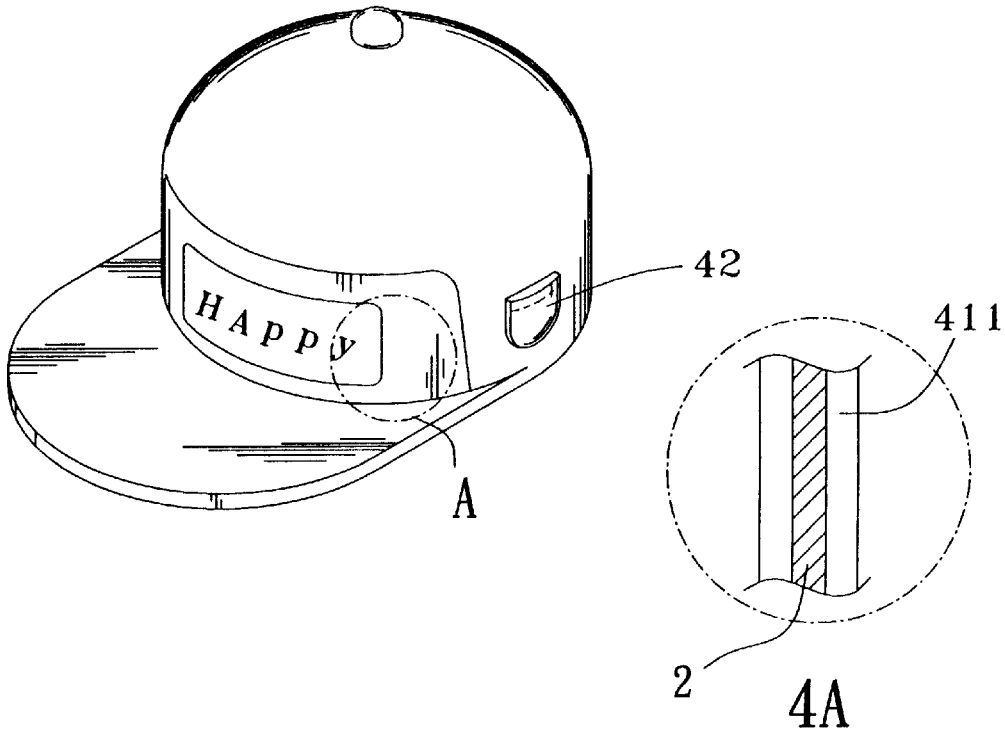
FIG. 4 is a perspective view of the present invention.
Figure 5A:
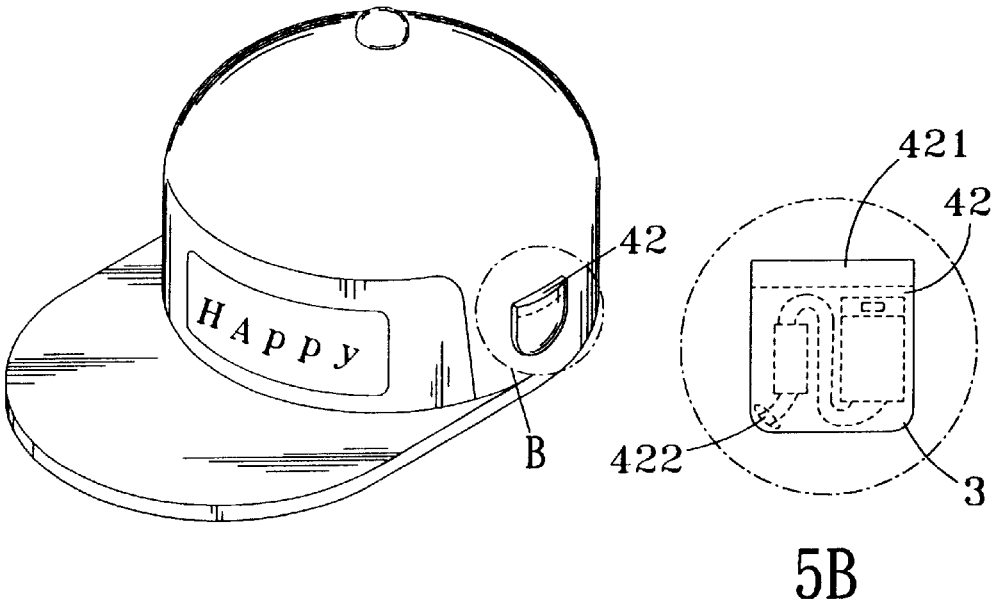
FIG. 5A is a cross-sectional drawing of the containment section B of FIG. 5.

Referring to FIG. 3, FIG. 4, and FIG. 5, the design of the invention herein is comprised of an improved multifunction cap that can be utilized during the day or night, with the improvement being the inclusion of a placement section 41 on the front surface of the cap 4 having incisions 411 on two sides and capable of accommodating the insertion of a luminescent picture 2. The luminescent picture 2 consists of a glowing phosphor powder image or a cold light board; when a luminescent picture 2 of somewhat larger dimensions than the placement section 41 is inserted into the seamed incisions 411, since the luminescent picture 2 is positioned on the exterior side of the placement section 41, the interior side of the placement section 41 becomes a separator that isolates the forehead of the user from contact with the luminescent picture 2 and thereby prevents electrocution. Furthermore, a containment section 42 is fabricated on the side of the cap 4 that serves as an object holding pocket which has at the top edge an adhesive strip 421 or other opening closure of similar design which prevents the controller circuit 3 from becoming loosened or dislodged when the user runs or repeatedly wears and removes the cap 4. A small hole 422 is appropriately disposed to provide for the insertion and routing of the wiring from the controller circuit 3 connected to the luminescent picture 2 that operates the power source of the luminescent picture 2. As described in the foregoing section, the cap design of the invention herein is genuinely capable of preventing electrical shock to the user while the cap is worn to ensure physical safety, while also being visually attractive.

Figure 6:
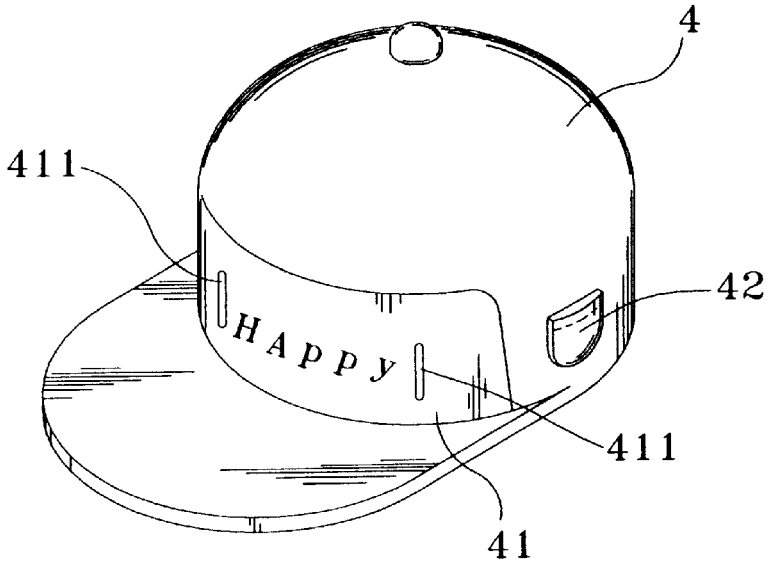
FIG. 6 is an isometric drawing of the preferred embodiment of the invention herein.

Referring to FIG. 6, any pattern can be directly drawn or mounted on the placement section 42 of the invention herein, enabling the invention herein to remain wearable, attractive, and practical for day or night use even when the luminescent picture 2 is inoperable and not installed.

In summation of the foregoing section, the improved structure multifunction cap of the invention herein has greater practical value than the conventional product and, furthermore, the structure and functions are innovative, original, and capable of additional performance.

What is claimed is:

1. A multifunctional cap comprising:

a) a cap portion engageable with a head of a user, the cap portion bounding an interior and having an exterior surface;

b) a placement section on the cap portion, the placement section having a plurality of spaced apart incisions;

c) a luminescent picture panel having opposite side edges, a picture surface and a rear surface facing opposite to the picture surface, the opposite side edges engaging the spaced apart incisions so as to removably attach the luminescent picture panel to the placement section such that the rear surface contacts the placement section and the picture surface faces outwardly from the cap;

d) a containment section located on the exterior surface of the cap portion; and, e) a controller circuit retained in the containment section and electrically connected to the luminescent picture panel.

2. The multifunctional cap of claim 1 further comprising indicia on the placement section visible when the luminescent picture panel is removed from the placement section.

3. The multifunctional cap of claim 1 wherein the containment section comprises a holding pocket having an open top edge and further comprising a closure element to close the open top edge.

4. The multifunctional cap of claim 1 wherein the luminescent picture panel has a glowing phosphor powder image.

5. The multifunctional cap of claim 1 wherein the luminescent picture panel comprises a cold light board.

* * * * *